US006598436B2

(12) United States Patent
Ponn et al.

(10) Patent No.: US 6,598,436 B2
(45) Date of Patent: Jul. 29, 2003

(54) VEHICLE LOCK DEVICE

(75) Inventors: Helmut Ponn, Torlanda (SE); Stig Hermansson, Kungälv (SE)

(73) Assignee: Volvo Car Corporation, Göteborg (SE)

( * ) Notice: Subject to any disclaimer, the term of this patent is extended or adjusted under 35 U.S.C. 154(b) by 0 days.

(21) Appl. No.: 09/683,234

(22) Filed: Dec. 4, 2001

(65) Prior Publication Data

US 2003/0033842 A1 Feb. 20, 2003

(Under 37 CFR 1.47)

Related U.S. Application Data

(63) Continuation of application No. PCT/SE00/00911, filed on May 9, 2000.

(51) Int. Cl.[7] ..... E05B 65/19

(52) U.S. Cl. ..... 70/256; 70/247; 70/252; 292/DIG. 25; 292/DIG. 14; 292/DIG. 42; 292/201; 292/216

(58) Field of Search ..... 70/256, 252, 245, 70/247, 248, 251, 182–186, 240; 292/DIG. 14, DIG. 42, DIG. 43, DIG. 25, 201, 216, 144

(56) References Cited

U.S. PATENT DOCUMENTS

| | | | | | |
|---|---|---|---|---|---|
| 4,945,784 | A | * | 8/1990 | Gergoe | 292/DIG. 25 X |
| 4,962,955 | A | * | 10/1990 | Ferrara et al. | 292/216 |
| 4,986,098 | A | * | 1/1991 | Fisher | 292/216 X |
| 4,998,758 | A | * | 3/1991 | Kowalczyk et al. | 292/201 |
| 5,218,847 | A | * | 6/1993 | Dieden et al. | 70/247 |
| 5,226,303 | A | * | 7/1993 | Dieden et al. | 70/247 |
| 5,233,849 | A | * | 8/1993 | Forbers | 70/256 |
| 5,379,871 | A | * | 1/1995 | Asano et al. | 192/4 A |
| 5,685,198 | A | * | 11/1997 | Hawkins | 74/502.2 |
| 5,894,749 | A | * | 4/1999 | Tomaszewski et al. | 70/240 |
| 6,047,576 | A | * | 4/2000 | Lanigan et al. | 70/256 X |
| 6,050,619 | A | * | 4/2000 | Arabia et al. | 292/216 |
| 6,098,490 | A | * | 8/2000 | Kowalewski et al. | 74/506 |

FOREIGN PATENT DOCUMENTS

| | | |
|---|---|---|
| DE | 9311377 U1 | 11/1993 |
| DE | 4406236 A1 | 8/1995 |
| EP | 0805248 A2 | 11/1997 |
| FR | 2755991 A1 | 5/1998 |
| GB | 2291109 A | 1/1996 |
| WO | WO 9831904 A1 | 7/1998 |

* cited by examiner

*Primary Examiner*—Suzanne Dino Barrett
(74) *Attorney, Agent, or Firm*—Howrey, Simon, Arnold & White LLP

(57) ABSTRACT

A device for the transmission of unlocking force from a lock cylinder arranged in a lock cylinder casing to an operating arm in a locking mechanism, especially in a vehicle lock. The device is characterized in that a first end of a cable sheath is fixed to the lock cylinder casing adjacent to the lock cylinder. A second end of the cable sheath is fixed adjacent to the operating arm of the locking mechanism. A first end of a cable arranged in the cable sheath is operatively connected to the lock cylinder, the first end of the cable being designed, when duly acted upon by the lock cylinder for unlocking the door, to be pushed into the cable sheath, thereby causing a second free end of the cable to be pushed out of the other end of the cable sheath and brought into engagement with the operating arm, and by way of the latter transmitting to the locking mechanism the requisite force/movement needed to bring the locking mechanism from a locked position (X) into an unlocked position (Y).

4 Claims, 1 Drawing Sheet

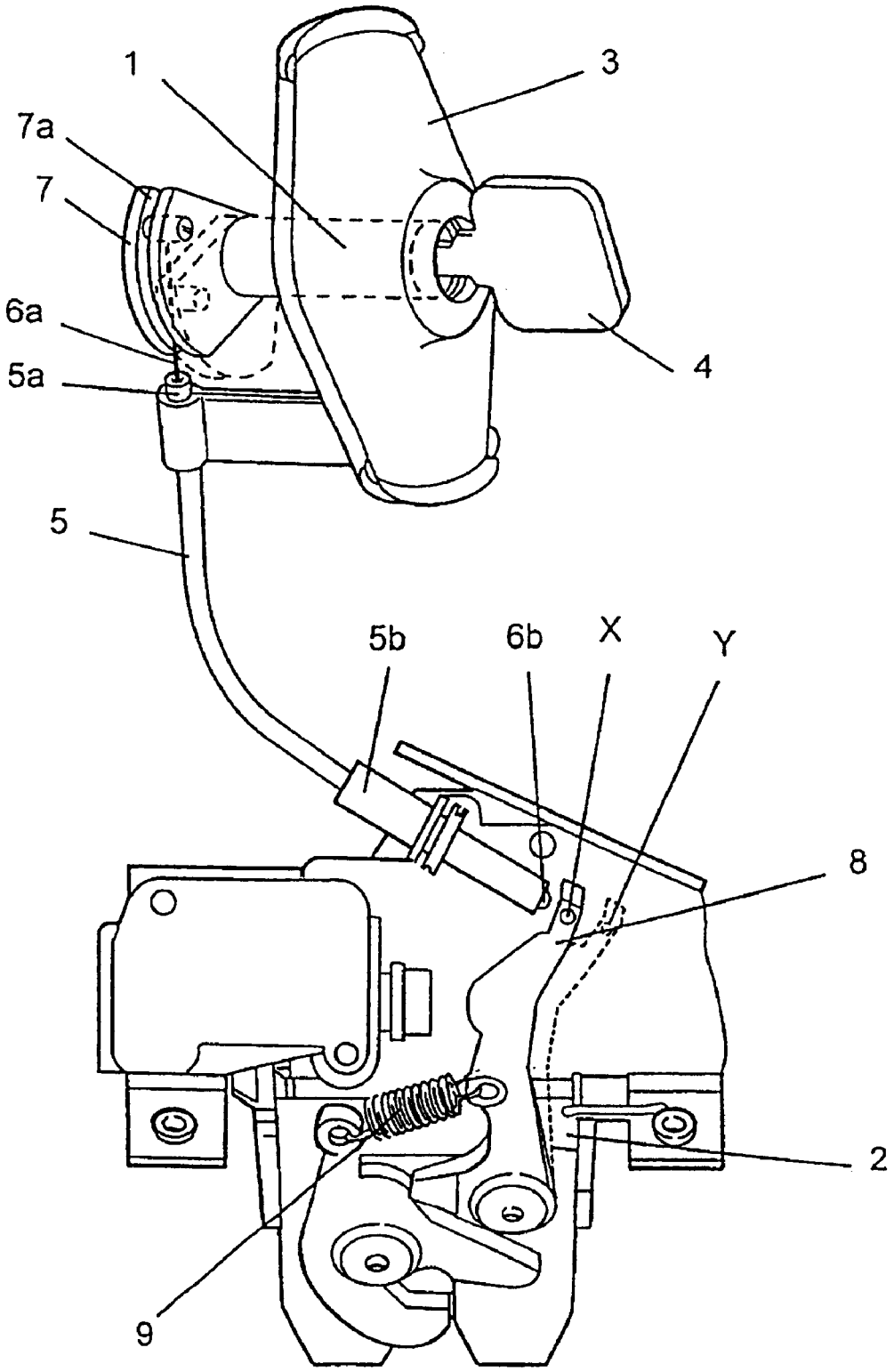
1
3
7a
7
6a
5a
4
5
5b
6b
X
Y
8
2
9

VEHICLE LOCK DEVICE

CROSS REFERENCE TO RELATED APPLICATIONS

The present application is a continuation of International Application No. PCT/SE00/00911, filed May 9, 2000, which claims priority to Swedish Application No. 9902092-7, filed Jun. 4, 1999. Both applications are expressly incorporated herein by reference.

BACKGROUND OF THE INVENTION

1. Technical Field

The present invention relates to a vehicle lock device. More specifically, the invention relates to a lock device for transmitting an unlocking force from a lock cylinder in a lock cylinder casing to an operating arm in a locking mechanism.

2. Background Information

Transmitting the unlocking or locking force between a lock cylinder and a locking mechanism by means of rods or draw or push cables fixed to an operating arm in the locking mechanism is known. One example of such a known device is disclosed in European Patent No. 0 475 037. However, such known devices can be relatively easy for a car thief to tamper with. For example, where a draw cable is used, the car thief can slip a hooked implement down inside a vehicle door for catching hold of the cable and pulling it in order to unlock the door. In order to make this more difficult, it is now common to arrange protective covers in the vehicle door that prevent access to the cable. Still, the covers increase the weight and cost of the vehicle.

Where rods are used to transmit the unlocking or locking force, a car thief can sometimes manage to displace the rod enough to unlock the door. This is accomplished by introducing an implement into the lock cylinder and breaking the lock cylinder and the lock cylinder casing around its fixing in the vehicle. In order to make this more difficult, it is common to provide the fixing for the lock cylinder casing with strong reinforcements so that the necessary bending moment cannot be easily applied to the lock cylinder casing. However, as before, these reinforcements also increase the weight and cost of the vehicle. Furthermore, both of the above-mentioned solutions may be adversely affected in the event of a collision at moderate speed, since deformation of the vehicle adjacent to the locking devices may mean that the locking function/unlocking function is jeopardized by the exposure of a cable to tensile force or by displacement of a rod.

Accordingly, there is a need for a locking device that is simple in design, low in cost and weight, while also difficult for a car thief to tamper with.

SUMMARY OF INVENTION

The present invention provides a device for transmitting an unlocking force from a lock cylinder arranged in a lock cylinder casing to a locking mechanism. The invention is especially applicable to vehicle locks. The device is simple, has a low weight and entails a relatively low cost. At the same time, the device is very difficult for a car thief to tamper with in order to unlock the door.

The present invention further provides a device for transmitting an unlocking force from a lock cylinder to a locking mechanism that remains substantially unaffected and safeguards the opening function in the event of a collision at moderate speed.

According to one embodiment of the present invention a device for transmitting an unlocking force from a lock cylinder arranged in a lock cylinder casing to a locking mechanism or operating arm includes a cable sheath. The cable sheath has a first end that is fixed or connected to the lock cylinder casing, and a second end fixed or connected to the operating arm of the locking mechanism. A cable is arranged in the cable sheath and is operatively connected to the lock cylinder with a first end of the cable. The first cable end is designed, when acted upon by the lock cylinder for unlocking the door, to be pushed into the cable sheath, causing a second cable free end to be pushed out the other end of the cable sheath and brought into engagement with the operating arm. With the operating arm, the second cable end is able to transmit to the locking mechanism the requisite force or movement needed to bring the locking mechanism from a locked position to an unlocked position.

A displacement element for the cable is arranged in the lock cylinder. The element forms a moment arm between the axis of rotation of the lock cylinder and the placement of the first cable end in the displacement element. The element is designed to impart to the first cable end the necessary displacement in relation to the cable sheath when acted upon by the lock cylinder for unlocking the door. Additionally, the element receives and protects that part of the first cable end that protrudes from the first end of the cable sheath.

In one embodiment, the displacement element for the cable has a groove corresponding to the cable. The groove is of sufficient depth and length to accommodate the part of the cable that protrudes from the first end of the cable sheath.

In another embodiment of the invention, the operating arm, when not acted upon by the second free end of the cable, is designed to return to the locked position by device such as a spring.

The device according to the invention has a number of advantages. Among other things it is very difficult for a car thief to tamper with. The car thief cannot manage to unlock a vehicle door by slipping a hooked implement down inside the door, catching hold of the cable and pulling the latter. The protective covers now common in the vehicle doors can thereby be dispensed with, making it possible to reduce the weight and cost of the vehicle. Nor can the car thief, as may happen where rods are used for the transmission of forces, manage to displace the cables in relation to the cable sheath in order to unlock the door, by inserting an implement into the cylinder lock and breaking the cylinder lock and the lock cylinder casing around its fixing in the vehicle. This means that the reinforcements now common for fixing the lock cylinder casing can be dispensed with, which in turn means that it is possible to reduce the weight and cost of the vehicle. Furthermore, the solution according to the invention is not affected in the context of a collision at moderate speed, since certain deformation of the vehicle adjacent to the lock devices does not result in relative displacement between the cable and the cable sheath, thereby safeguarding the opening function following a collision at moderate speed.

BRIEF DESCRIPTION OF DRAWINGS

The invention will be explained in greater detail below with the aid of the attached figure, which illustrates an embodiment of the device according to the present invention, wherein:

The FIGURE is a perspective view of the lock cylinder and locking mechanism arrangement according to the present invention.

DETAILED DESCRIPTION

Referring to the FIGURE, there is illustrated a general drawing of a preferred embodiment of the device according to the invention for transmitting an unlocking force from a lock cylinder 1 to an operating arm 8 in a locking mechanism 2. The locking mechanism may be arranged, for example, in a vehicle lock such as a vehicle door lock or trunk lock.

The lock cylinder 1 is located in a lock cylinder casing 3 and is found or positioned at a distance from the locking mechanism 2. The lock cylinder casing 3 is fitted in connection with an opening in the vehicle for introducing a key 4 into the lock cylinder 1.

A first end 5*a* of a cable sheath 5 is connected to the lock cylinder 1. The first end 5*a* is preferably fixed in relation to the lock cylinder casing 3. The cable sheath 5 is arranged so that it does not twist when the lock cylinder 1 is turned by a key 4. The sheath 5 is designed to follow with the lock cylinder 1 and the lock cylinder casing 3. However, it is displaced in relation to the lock cylinder 1 in the event of improper insertion of an implement into the lock cylinder 1 and breaking of the lock cylinder 1 and the lock cylinder casing 3 around its fixing in the vehicle.

Protruding from the first end 5*a* of the cable sheath 5 is a first end 6*a* of a cable 6 arranged in the cable sheath 5. The first cable end 6*a* is operatively connected to the lock cylinder 1 by means of a displacement element 7 for the cable 6. The displacement element 7 is arranged in the lock cylinder extension. The element 7 forms a moment arm between the axis of rotation of the lock cylinder 1 and the placement of the first cable end in the element 7.

Connected to the locking mechanism 2 adjacent to its operating arm 8 is a second end 5*b* of the cable sheath 5. A second free end 6*b* of the cable 6 protrudes from the other end 5*b* of the cable sheath 5. This second cable end 6*b* is aligned for engagement with the operating arm 8 arranged in the locking mechanism 2. The first cable end 6*a* is designed, when duly acted upon by the lock cylinder 1 in unlocking the door, to be displaced by the displacement element 7 in relation to the cable sheath 5. The first cable end 6*a* is pushed into the sheath 5, forcing the second free end of the cable 6 out of the cable sheath 5 and into engagement with the operating arm 8. This results in the operating arm 8 transmitting the requisite unlocking force/movement to the locking mechanism 2. In the Figure, the operating arm 8 is shown by solid lines in a locked position X and by dashed lines in an unlocked position Y. In the locking process the operating arm 8 is drawn back into the locked position X by a retractor such as a spring 9.

The displacement element 7 preferably includes a groove 7*a* for receiving that part of the cable 6 that protrudes from the first end 5*a* of the cable sheath. The groove 7*a* is preferably designed to protect the cable 6 and to prevent access to it. The groove 7*a* is preferably of such sufficient length and depth that it accommodates that part of the first end 6*a* of the cable that protrudes from the first end 5*a* of the cable sheath 5 in the locked position. As illustrated, the displacement element 7*a* is shown in the unlocked position by dashed lines, and in the locked position by solid lines.

While there has been disclosed effective and efficient embodiments of the invention using specific terms, it should be well understood that the invention is not limited to such embodiments as there might be changes made in the arrangement, disposition, and form of the parts without departing from the principle of the present invention as comprehended within the scope of the accompanying claims.

What is claimed is:

1. A device for transmitting an unlocking force from a lock cylinder arranged in a lock cylinder casing to an operating arm in a locking mechanism, the device comprising:

a cable sheath, a first end of the cable sheath connected to the lock cylinder casing, a second end of the cable sheath connected to the locking mechanism adjacent to the operating arm, a cable, a first end of the cable arranged in the cable sheath and operatively connected to the lock cylinder, a second free end of the cable arranged in the cable sheath and engageable with the operating arm, wherein the first end of the cable, when duly acted upon by the lock cylinder for unlocking the door, pushes into the cable sheath causing the second cable free end to be pushed out of the other end of the cable sheath and brought into engagement with the operating arm, transmitting to the locking mechanism the requisite force/movement needed to bring the locking mechanism from a locked position into an unlocked position, and a displacement element for the cable arranged in the lock cylinder, the element forming a moment arm between the axis of rotation of the lock cylinder and the placement of the first cable end in the displacement element, wherein the element is able to impart to the first cable end the requisite displacement in relation to the cable sheath when duly acted upon by the lock cylinder for unlocking the door, and wherein the element is able to receive and protect that part of the first cable end that protrudes from the first end of the cable sheath.

2. The device according to claim 1, wherein the displacement element for the cable further comprises a groove corresponding to the cable, the groove being of sufficient length and depth to accommodate that part of the cable that protrudes from the first end of the cable sheath.

3. The device according to claim 1, further comprising a retractor for returning the operating arm to the locked position when not being acted upon by the second free end of the cable.

4. The device according to claim 3 wherein the retractor is a spring.

* * * * *

UNITED STATES PATENT AND TRADEMARK OFFICE

CERTIFICATE OF CORRECTION

PATENT NO. : 6,598,436 B2
DATED : July 29, 2003
INVENTOR(S) : Ponn et al.

It is certified that error appears in the above-identified patent and that said Letters Patent is hereby corrected as shown below:

Title page,
Item [75], please correct the city of residence of inventor "Helmut Ponn" as follows:
-- Helmut Ponn, Torslanda (SE) --
Insert: -- Foreign Application Priority Data
[30] June 4, 1999 (SE) ……...9902092-7 --

Signed and Sealed this

Eleventh Day of November, 2003

JAMES E. ROGAN
*Director of the United States Patent and Trademark Office*